US011384581B2

(12) United States Patent
Tomizawa et al.

(10) Patent No.: US 11,384,581 B2
(45) Date of Patent: Jul. 12, 2022

(54) DOOR OPENING/CLOSING APPARATUS AND HINGE

(71) Applicant: SUGATSUNE KOGYO CO., LTD., Tokyo (JP)

(72) Inventors: Kenji Tomizawa, Tokyo (JP); Ryo Niimi, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 17/288,337

(22) PCT Filed: Oct. 4, 2019

(86) PCT No.: PCT/JP2019/039266
§ 371 (c)(1),
(2) Date: Apr. 23, 2021

(87) PCT Pub. No.: WO2020/085043
PCT Pub. Date: Apr. 30, 2020

(65) Prior Publication Data

US 2021/0381291 A1 Dec. 9, 2021

(30) Foreign Application Priority Data

Oct. 23, 2018 (JP) ..... JP2018-198999

(51) Int. Cl.
*E05D 3/06* (2006.01)
*E05D 15/34* (2006.01)
*E06B 7/36* (2006.01)

(52) U.S. Cl.
CPC ..... *E05D 15/34* (2013.01); *E05D 3/06* (2013.01); *E06B 7/367* (2013.01); *E05Y 2900/20* (2013.01)

(58) Field of Classification Search
CPC ..... Y10T 16/547; Y10T 16/5475; Y10T 16/5476; Y10T 16/551; E05D 15/34;
(Continued)

(56) References Cited

U.S. PATENT DOCUMENTS 4,393,623 A 7/1983 Munz
4,700,984 A 10/1987 Kinaga et al.
(Continued)

FOREIGN PATENT DOCUMENTS

CN 102112693 A 6/2011
CN 105019749 A 11/2015
(Continued)

OTHER PUBLICATIONS

International Search Report for PCT/JP2019/039266 dated Nov. 26, 2019, 2 pages.
(Continued)

*Primary Examiner* — Chuck Y Mah
(74) *Attorney, Agent, or Firm* — Nixon & Vanderhye

(57) ABSTRACT

A door opening/closing apparatus is provided which can expand storage space in a main body. A door opening/closing apparatus includes at least two hinges, and a connecting bar that is connected to the at least two hinges. Each hinge includes a main body-side member, a door-side member, a main arm, a first link, and a second link, and causes a door to move parallel to itself between a closed position and an open position. The main arm includes a bent portion. The connecting bar is mounted on a door side of the main arm. A center of the connecting bar in a width direction thereof is placed on a second shaft side relative to a center between a first shaft and the second shaft of the main arm in a front view of the door in a state where the door is in the closed position.

8 Claims, 12 Drawing Sheets

(58) Field of Classification Search
CPC ..... E05D 15/28; E05D 15/30; E05D 15/32; E05D 3/06; E05D 3/08; E05D 3/14; E05D 3/16; E06B 7/36; E06B 7/367; E05Y 2900/20
See application file for complete search history.

(56) References Cited

U.S. PATENT DOCUMENTS

| | | | | |
|---|---|---|---|---|
| 6,052,870 | A * | 4/2000 | Hagenlocher | E05D 3/147 296/146.12 |
| 6,647,592 | B2 * | 11/2003 | Presley | E05D 3/145 16/288 |
| 7,150,492 | B2 * | 12/2006 | Nania | E05D 3/127 16/334 |
| 7,971,320 | B2 * | 7/2011 | Fain | E05D 3/127 16/366 |
| 8,007,026 | B2 * | 8/2011 | Scott | E05D 3/127 296/146.12 |
| 10,968,671 | B2 * | 4/2021 | Dey | E05D 11/00 |
| 2005/0011045 | A1 | 1/2005 | Lu et al. | |
| 2010/0257700 | A1 | 10/2010 | Osaki | |
| 2011/0185637 | A1 * | 8/2011 | Uto | E02F 9/00 16/374 |
| 2011/0204072 | A1 * | 8/2011 | Sugasawara | E05D 3/14 16/382 |
| 2013/0257238 | A1 * | 10/2013 | Herron | C12M 41/36 312/325 |
| 2015/0315831 | A1 | 11/2015 | Lobkovich et al. | |

FOREIGN PATENT DOCUMENTS

| | | | |
|---|---|---|---|
| CN | 107429531 | A | 12/2017 |
| DE | 29 50 857 | A1 | 7/1981 |
| EP | 2 363 560 | A1 | 9/2011 |
| EP | 3 272 979 | A1 | 1/2018 |
| JP | 60-19258 | | 6/1985 |
| JP | 2004-360180 | A | 12/2004 |
| JP | 2010-242427 | | 10/2010 |
| JP | 2011-212090 | | 10/2011 |
| JP | 2012-67598 | A | 4/2012 |
| JP | 5291810 | | 6/2013 |
| JP | 2018-35532 | A | 3/2018 |
| KR | 2012122428 | A * | 11/2012 |

OTHER PUBLICATIONS

Chinese Office Action issued for Chinese Patent Application No. 201980065801.7, dated Feb. 28, 2022.

* cited by examiner

UP
BACK
RIGHT
DOWN
LEFT
FRONT
5
2a
2b
3
4
1
11
12
13
14
15

DOOR OPENING/CLOSING APPARATUS AND HINGE

This application is the U.S. national phase of International Application No. PCT/JP2019/039266 filed Oct. 4, 2019 which designated the U.S. and claims priority to JP Patent Application No. 2018-198999 filed Oct. 23, 2018, the entire contents of each of which are hereby incorporated by reference.

TECHNICAL FIELD

The present invention relates to a door opening/closing apparatus and hinge that causes a door to move parallel to itself between a closed position and an open position.

BACKGROUND ART

The applicants have proposed a door opening/closing apparatus illustrated in FIG. 11 as this type of door opening/closing apparatus (refer to Patent Literature 1). The door opening/closing apparatus includes a pair of hinges 51*a* and 51*b*, and a connecting bar 52 that is connected to the pair of hinges 51*a* and 51*b*.

As illustrated in FIGS. 12A and 12B, the hinges 51*a* and 51*b* each include a main body-side member 55 that is mounted on an inner surface of a main body 53, a door-side member 56 that is mounted on the back of a door 54, a main arm 58 that is pivotably connected to the main body-side member 55 and the door-side member 56, a first link 57 that is pivotably connected to the main body-side member 55 and the door-side member 56, and a second link 59 that is pivotably connected to the main body-side member 55 and the door-side member 56. Three first shafts 58*a*, 57*a*, and 59*a* about which the main arm 58, the first link 57, and the second link 59 pivot relative to the main body-side member 55 are placed on the vertices of a triangle in axial view. Similarly, three second shafts 58*b*, 57*b*, and 59*b* about which the main arm 58, the first link 57, and the second link 59 pivot relative to the door-side member 56 are placed on the vertices of a triangle in axial view.

The main body-side member 55, the door-side member 56, the main arm 58, and the first link 57 configure a parallel linkage mechanism (also called a parallel crank mechanism) in terms of mechanics. Hence, the door 54 moves parallel to itself between a closed position and an open position. However, if only the main body-side member 55, the door-side member 56, the main arm 58, and the first link 57 are used, a change point may occur with the closing and opening of the door 54, and the mechanism becomes unstable. Hence, the second link 59 is added to prevent the mechanism from becoming unstable.

As illustrated in FIG. 12B, the main arm 58 includes a bent portion 58*c* to prevent the main arm 58 from interfering with the main body 53 and interfering with an unillustrated neighboring door in the open position of the door 54.

As illustrated in FIG. 11, the connecting bar 52 is connected to the main arms 58 of the pair of hinges 51*a* and 51*b*, which causes the pair of hinges 51*a* and 51*b* to work in an interlocked fashion and causes the door 54 to stably open and close even if the door 54 is heavy.

CITATION LIST

Patent Literature

Patent Literature 1: Japanese Patent No. 5291810

SUMMARY OF INVENTION

Technical Problem

As illustrated in FIG. 11, however, the connecting bar 52 is mounted on the main body 53 side of the main arm 58 and near the bent portion 58*c* of the main arm 58 in the known door opening/closing apparatus. The connecting bar 52 runs from the top to bottom of the main body 53. Accordingly, there is a problem that the connecting bar 52 interferes with storage, which results in a reduction in storage space in the main body 53.

The present invention has been made considering the above problem, and an object thereof is to provide a door opening/closing apparatus that can expand storage space in a main body.

Solution to Problem

In order to solve the above problem, one aspect of the present invention is a door opening/closing apparatus including: at least two hinges; and a connecting bar configured to be connected to the at least two hinges, in which each hinge has: a main body-side member configured to be mounted on an inner surface of a main body; a door-side member configured to be mounted on the back of a door; a main arm configured to be pivotably connected to the main body-side member and the door-side member; a first link configured to be pivotably connected to the main body-side member and the door-side member; and a second link configured to be pivotably connected to the main body-side member and the door-side member, three first shafts about which the main arm, the first link, and the second link pivot relative to the main body-side member are placed on vertices of a triangle in axial view, three second shafts about which the main arm, the first link, and the second link pivot relative to the door-side member are placed on vertices of a triangle in the axial view, the main arm has a bent portion, the door opening/closing apparatus causes the door to move parallel to itself between a closed position and an open position, the connecting bar is mounted on a door side of the main arm, and the center of the connecting bar in a width direction thereof is placed on the second shaft side relative to the center between the first shaft of the main arm and the second shaft of the main arm in a front view of the door in a state where the door is in the closed position.

Another aspect of the present invention is a hinge including: a main body-side member configured to be mounted on an inner surface of a main body; a door-side member configured to be mounted on the back of a door; a main arm configured to be pivotably connected to the main body-side member and the door-side member; a first link configured to be pivotably connected to the main body-side member and the door-side member; and a second link configured to be pivotably connected to the main body-side member and the door-side member, in which three first shafts about which the main arm, the first link, and the second link pivot relative to the main body-side member are placed on vertices of a triangle in axial view, three second shafts about which the main arm, the first link, and the second link pivot relative to the door-side member are placed on vertices of a triangle in the axial view, the main arm has a bent portion, the hinge causes the door to move parallel to itself between a closed position and an open position, a mounting portion of the main arm on which a connecting bar is mounted is placed on a door side of the main arm, and the center of the mounting portion in a width direction thereof is placed on the second shaft side relative to the center between the first shaft of the main arm and the second shaft of the main arm in a front view of the door in a state where the door is in the closed position.

Advantageous Effects of Invention

According to the present invention, a connecting bar can be put closer to the back of a door in a closed position. Hence, storage space in a main body can be expanded.

BRIEF DESCRIPTION OF DRAWINGS

(FIG. 1A illustrates a closed position of a door, FIG. 1B illustrates a midpoint position of the door, and FIG. 1C illustrates an open position of the door).

(FIG. 2A illustrates the closed position of the door, FIG. 2B illustrates the midpoint position of the door, and FIG. 2C illustrates the open position of the door).

(FIG. 3A illustrates a perspective view of the hinge as viewed from a main body side, and FIG. 3B illustrates a perspective view of the hinge as viewed from the door side).

(FIG. 5A illustrates a state where an assist arm has been incorporated into an arm body, and FIG. 5B illustrates a state where the assist arm has been removed from the arm body).

(FIG. 6A is a plan view, FIG. 6B is a right side view, FIG. 6C is a bottom view, and FIG. 6D is a left side view).

(FIG. 7A is a cross-sectional view taken along A-A in FIG. 6B, and FIG. 7B is a cross-sectional view taken along B-B in FIG. 6B).

(FIG. 8A illustrates the closed position of the door, FIG. 8B illustrates the midpoint position of the door, and FIG. 8C illustrates the open position of the door).

(FIG. 12A illustrates a closed position of a door, and FIG. 12B illustrates an open position of the door).

DESCRIPTION OF EMBODIMENTS

A door opening/closing apparatus of an embodiment of the present invention is described in detail hereinafter on the basis of the accompanying drawings. However, the door opening/closing apparatus of the present invention can be embodiment in various modes, and is not limited to the embodiment described in the description. The embodiment is provided with the intention of allowing those skilled in the art to fully understand the scope of the invention by fully disclosing the description.

Figures 1A, 1B, 1C:
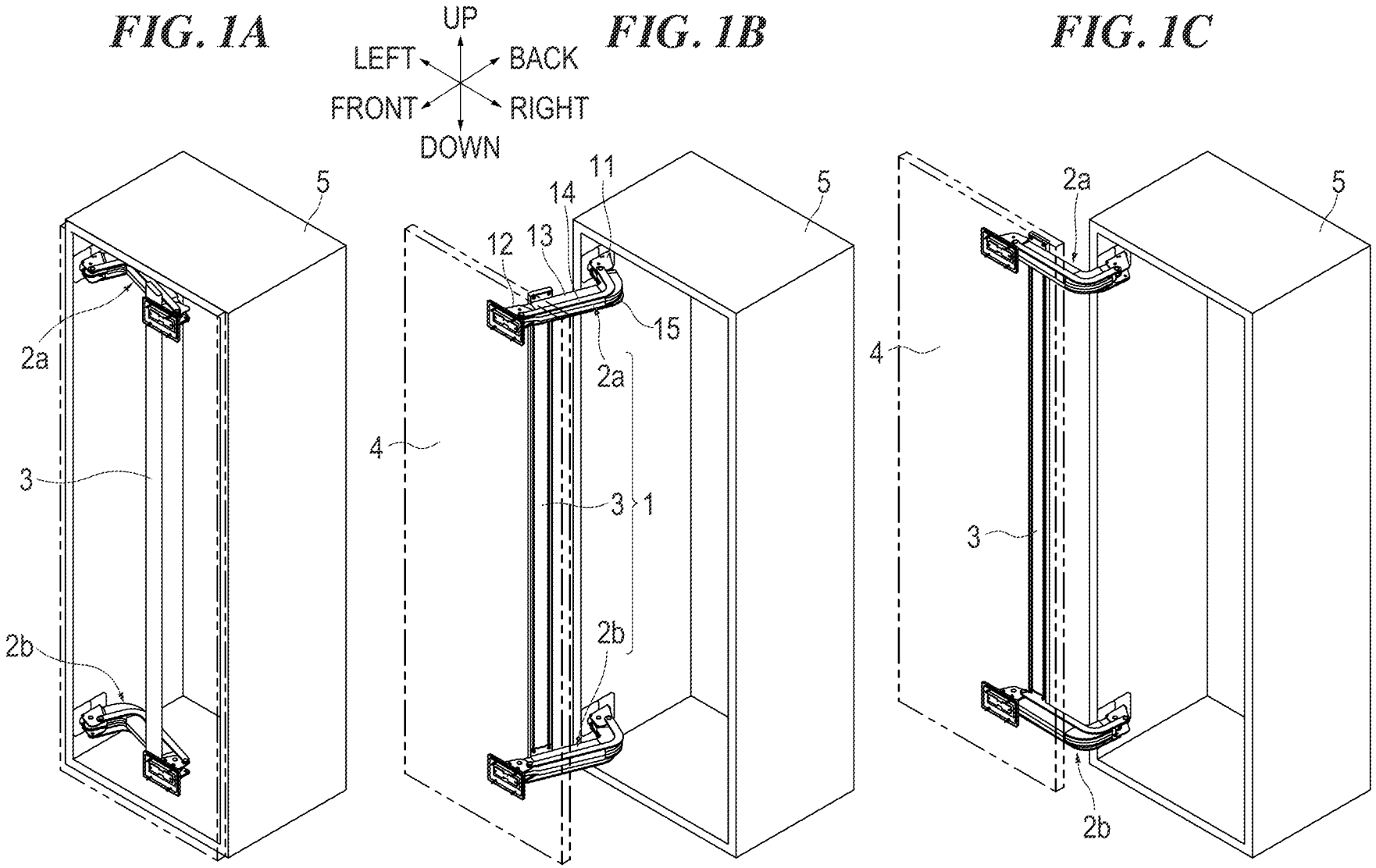
FIGS. 1A to 1C are perspective views of a front side of a cabinet using a door opening/closing apparatus of one embodiment of the present invention
Figure 2C:
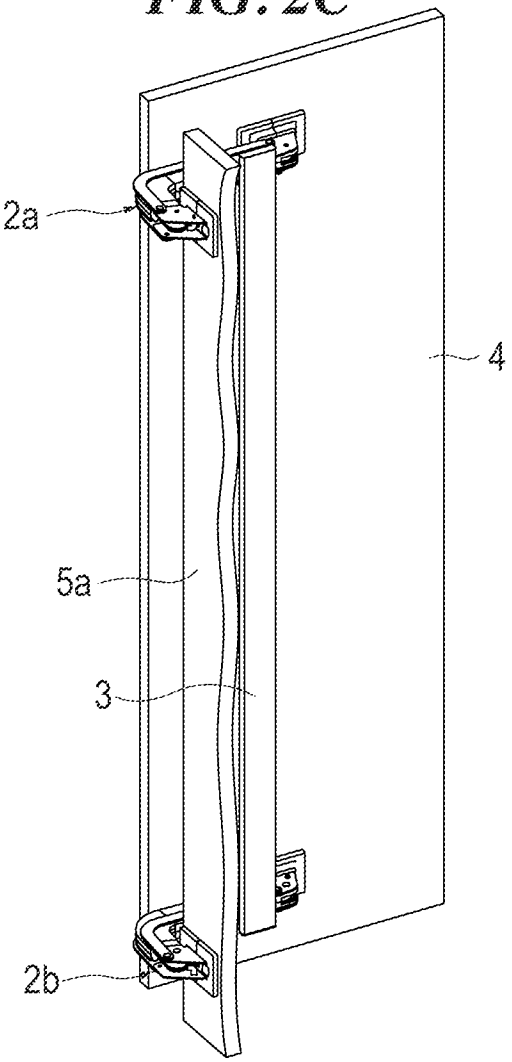
FIGS. 2A to 2C are perspective views of a back side of the cabinet
Figure 2B:
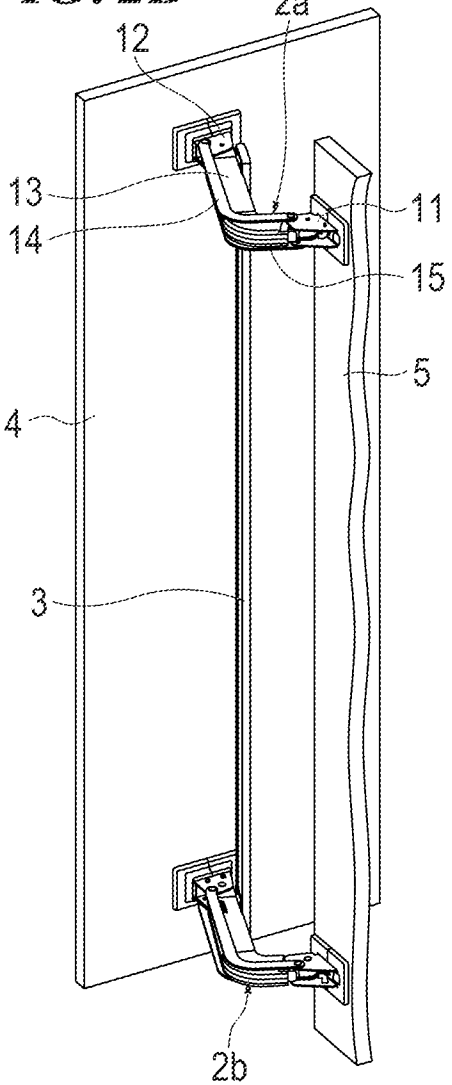
Figure 2A:
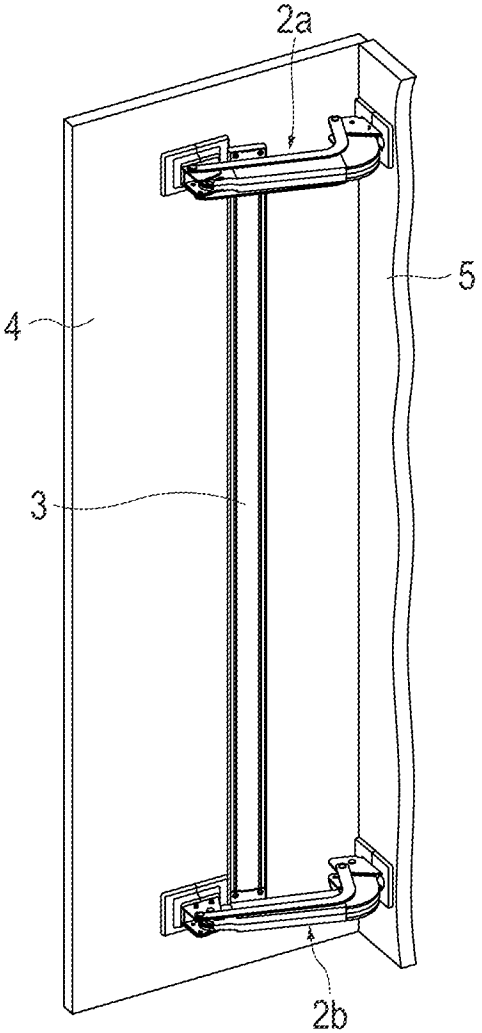

FIGS. 1A to 1C are perspective views of a front side of a cabinet using a door opening/closing apparatus 1 of one embodiment of the present invention (a door 4 is indicated by chain double-dashed lines). FIGS. 2A to 2C are perspective views of a back side of the cabinet (a part of a main body 5 is indicated by a break line). For convenience of description, directions of when the door 4 is viewed from the front, that is, the directions illustrated in the figures: front and back; up and down; and left and right, are used below to describe the configuration of the door opening/closing apparatus 1. Naturally, the placement of the door opening/closing apparatus 1 is not limited to the above.

FIG. 1A illustrates a closed position of the door 4. FIG. 1B illustrates a midpoint position of the door 4. FIG. 1C illustrates an open position of the door 4. A reference sign 2*a* denotes an upper hinge. A reference sign 2*b* denotes a lower hinge. A reference sign 3 denotes a connecting bar that connects the hinges 2*a* and 2*b*. The door opening/closing apparatus 1 includes a pair of the hinges 2*a* and 2*b*, and the connecting bar 3 that is connected to the pair of the hinges 2*a* and 2*b*. When the door 4 is pulled toward the front from the closed position illustrated in FIG. 1A, the door 4 performs pivotal motion, maintaining parallelism, and then opens to the open position illustrated in FIG. 1C through the midpoint position (the maximum opening projection toward the front) illustrated in FIG. 1B. The main body 5 is open to its full width in the open position.

Conversely, when the door 4 is pulled toward the front from the open position illustrated in FIG. 1C, the door 4 performs pivotal motion, maintaining parallelism, and then closes to the closed position illustrated in FIG. 1A through the midpoint position illustrated in FIG. 1B. A catch mechanism and a damper mechanism, which are described below, are incorporated into the hinges 2*a* and 2*b*. The catch mechanism causes the door 4 to automatically close right before the closed position. The damper mechanism causes the door 4 to softly close to the closed position.

The hinge 2*a* includes a main body-side member 11 that is mounted on an inner surface of a side plate 5*a* of the main body 5, a door-side member 12 that is mounted on the back of the door 4, a main arm 13 that is pivotably connected to the main body-side member 11 and the door-side member 12, a first link 14 that is pivotably connected to the main body-side member 11 and the door-side member 12, and a second link 15 that is pivotably connected to the main body-side member 11 and the door-side member 12. The main arm 13, the first link 14, and the second link 15 each include a bent portion, and are bent into an L-shape to prevent themselves from interfering with the side plate 5*a* of the main body 5 and an unillustrated neighboring door in the open position of the door 4 as illustrated in FIG. 2C.

The hinges 2*a* and 2*b* are configured to be the same or vertically symmetric. Only the configuration of the hinge 2*a* is described below, and the description of the hinge 2*b* is omitted.

Figure 3A:
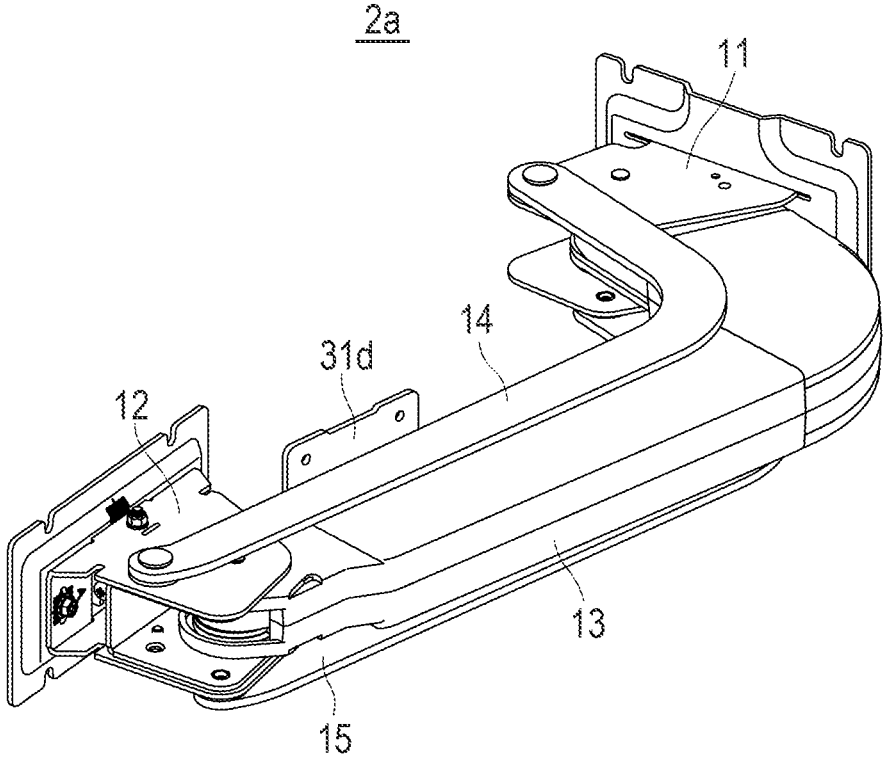
FIGS. 3A and 3B are perspective views of a hinge of the embodiment
Figure 3B:
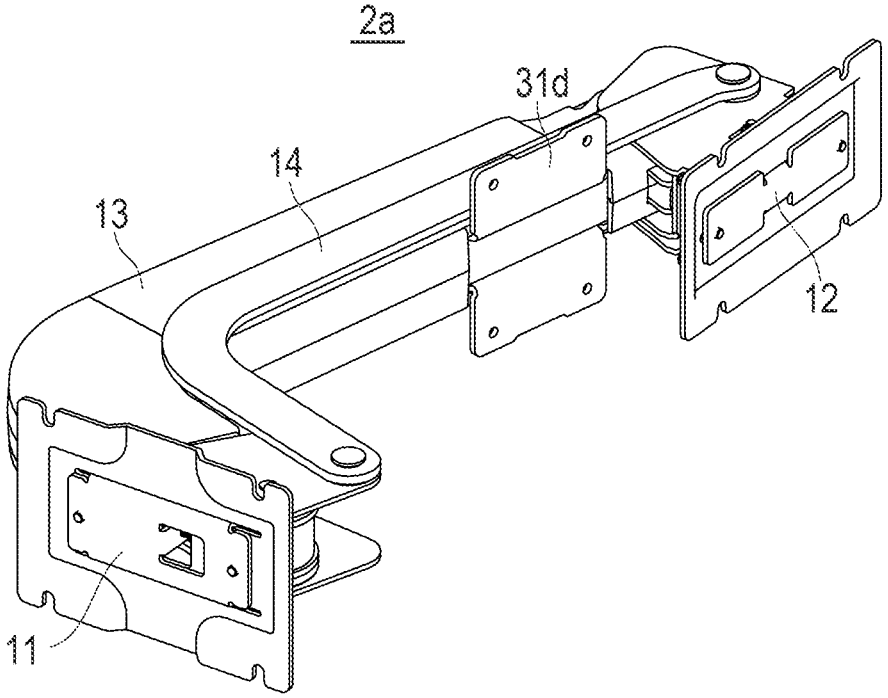

FIG. 3A illustrates a perspective view of the hinge 2*a* as viewed from the main body 5 side. FIG. 3B illustrates a perspective view of the hinge 2*a* as viewed from the door 4 side. The first link 14 is placed on one side (an upper side) of the main arm 13 in an axial direction (the up-and-down direction in FIG. 3A), displaced from the main arm 13. The second link 15 is placed on the other side (a lower side) of the main arm 13 in the axial direction (the up-and-down direction), displaced from the main arm 13.

Figure 4:
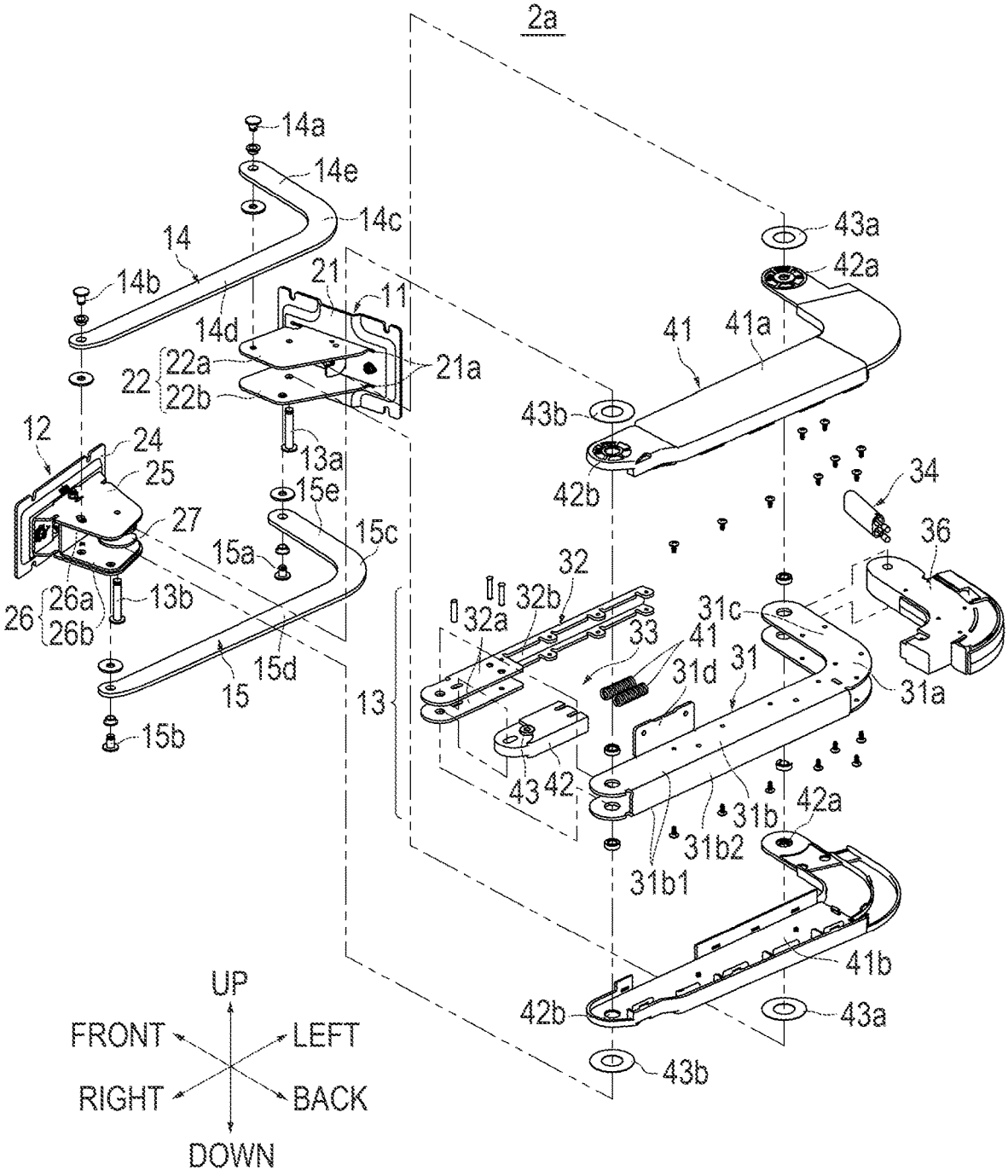
FIG. 4 is an exploded perspective view of the hinge of the embodiment.

FIG. 4 is an exploded perspective view of the hinge. The reference sign 11 denotes the main body-side member. The reference sign 12 denotes the door-side member. The reference sign 13 denotes the main arm. The reference sign 14 denotes the first link. The reference sign 15 denotes the second link.

Firstly, a linkage mechanism of the door opening/closing apparatus 1 is described. One end of the main arm 13 is connected to the main body-side member 11 in such a manner as to be pivotable about a first shaft 13*a*. The other end of the main arm 13 is connected to the door-side member 12 in such a manner as to be pivotable about a second shaft 13*b*. One end of the first link 14 is connected to the main body-side member 11 in such a manner as to be pivotable about a first shaft 14*a*. The other end of the first link 14 is connected to the door-side member 12 in such a manner as to be pivotable about a second shaft 14*b*. Similarly, one end of the second link 15 is connected to the main body-side member 11 in such a manner as to be pivotable about a first shaft 15*a*. The other end of the second link 15 is connected to the door-side member 12 in such a manner as to be pivotable about a second shaft 15*b*.

Figure 8A:
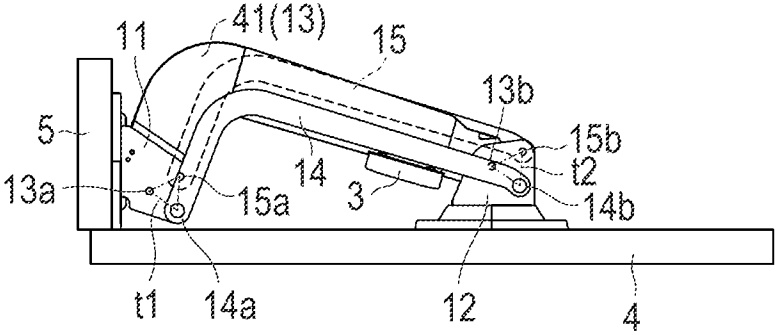
FIGS. 8A to 8C are plan views of the door opening/closing apparatus of the embodiment
Figure 8B:
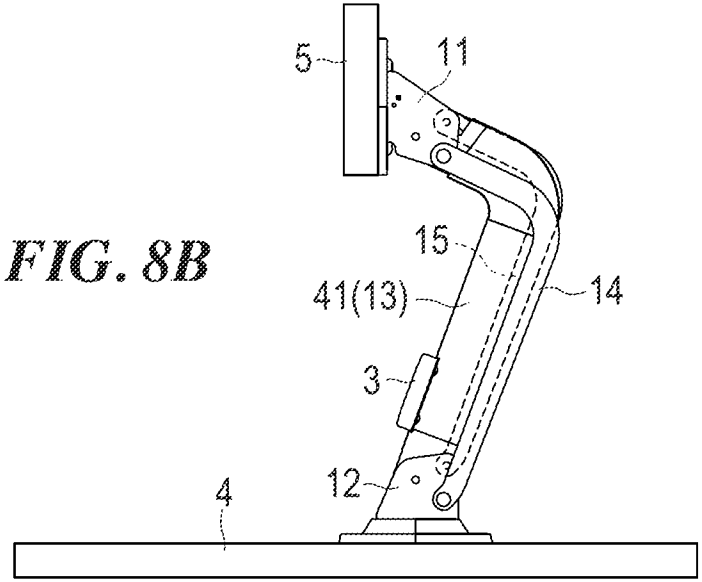
Figure 8C:
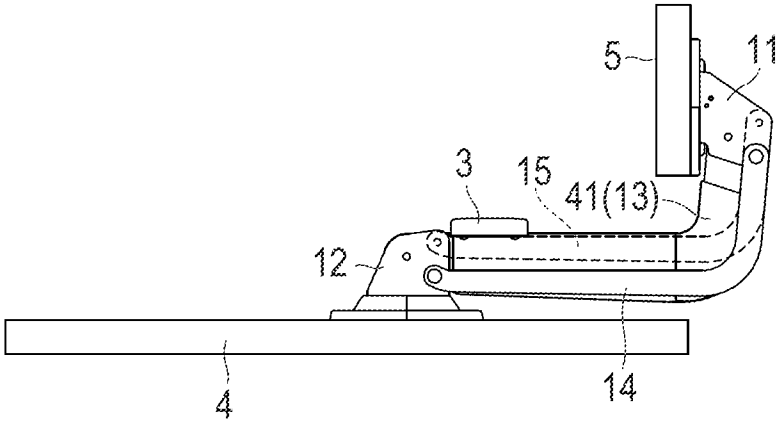

The pitch between the first shaft 13*a* and the second shaft 13*b* of the main arm 13, the pitch between the first shaft 14*a* and the second shaft 14*b* of the first link 14, and the pitch between the first shaft 15*a* and the second shaft 15*b* of the second link 15 are equal to each other. The three first shafts 13*a*, 14*a*, and 15*a* are placed on the vertices of a triangle in axial view. The three second shafts 13*b*, 14*b*, and 15*b* are also placed on the vertices of a triangle in axial view. When the door 4 opens and closes, a triangle t1 (refer to FIG. 8A) including the first shafts 13*a*, 14*a*, and 15*a*, and a triangle t2 (refer to FIG. 8A) including the second shafts 13*b*, 14*b*, and 15*b* maintain parallelism, and the door 4 moves parallel to itself between the closed position and the open position, as illustrated in FIGS. 8A to 8C.

Next, the configuration of each unit of the door opening/closing apparatus 1 is described. As illustrated in FIG. 4, the main body-side member 11 includes a plate 21 that is fixed to the main body 5 with a fastening member such as a screw, and a bracket 22 that is fixed to the plate 21 with a fastening member such as a screw in such a manner as to be adjustable in position in the front-and-back direction. The bracket 22 has a squared U-shape in cross section. A pair of side plates 22*a* and 22*b* of the bracket 22, which face each other, protrude from slits 21*a* in the plate 21. A hole into which the first shaft 13*a* of the main arm 13 is inserted is formed in the side plates 22*a* and 22*b*. A hole into which the first shaft 14*a* of the first link 14 is inserted is formed in the side plate 22*a*. A hole into which the first shaft 15*a* of the second link 15 is inserted is formed in the side plate 22*b*. The main arm 13 is placed between the pair of side plates 22*a* and 22*b*. The first link 14 and the second link 15 are placed on outer sides of the pair of side plates 22*a* and 22*b* in the axial direction.

The position of the bracket 22 is adjusted in the front-and-back direction relative to the plate 21; accordingly, the position of the door 4 can be adjusted in the front-and-back direction. After the adjustment, a washer cover 23 (refer to FIG. 7A) is mounted on the main body-side member 11.

As illustrated in FIG. 4, the door-side member 12 includes a plate 24 that is fixed to the door 4 with a fastening member such as a screw, a bracket 25 that is fixed to the plate 24 with a fastening member such as a screw in such a manner as to be adjustable in position in the left-and-right direction and in the up-and-down direction, an angle adjustment plate 26 that is fixed to the bracket 25 with a fastening member such as a screw in such a manner as to be adjustable in inclination, and a cam 27 that is fixed to the angle adjustment plate 26 with a fastening member such as a screw.

All of the bracket 25, the angle adjustment plate 26, and the cam 27 are formed into a squared U-shape in cross section. A hole into which the second shaft 13*b* of the main arm 13 is inserted is formed in side plates 26*a* and 26*b* of the angle adjustment plate 26. A hole into which the second shaft 14*b* of the first link 14 is inserted is formed in the side plate 26*a*. A hole into which the second shaft 15*b* of the second link 15 is inserted is formed in the side plate 26*b*. The main arm 13 is placed between a pair of the side plates 26*a* and 26*b* of the angle adjustment plate 26. The first link 14 and the second link 15 are placed on outer sides of a pair of side plates of the bracket 25 in the axial direction.

The position of the bracket 25 is adjusted in the left-and-right direction and in the up-and-down direction relative to the plate 24; accordingly, the position of the door 4 can be adjusted in the left-and-right direction and in the up-and-down direction. The inclination of the angle adjustment plate 26 relative to the bracket 25 is adjusted; accordingly, the inclination of the door 4 can be adjusted. After the adjustment, a washer cover 28 (refer to FIG. 7A) is mounted on the door-side member 12.

As illustrated in FIG. 4, the main arm 13 includes an arm body 31, an assist arm 32, a catch mechanism 33, and a damper mechanism 34.

Figure 5A:
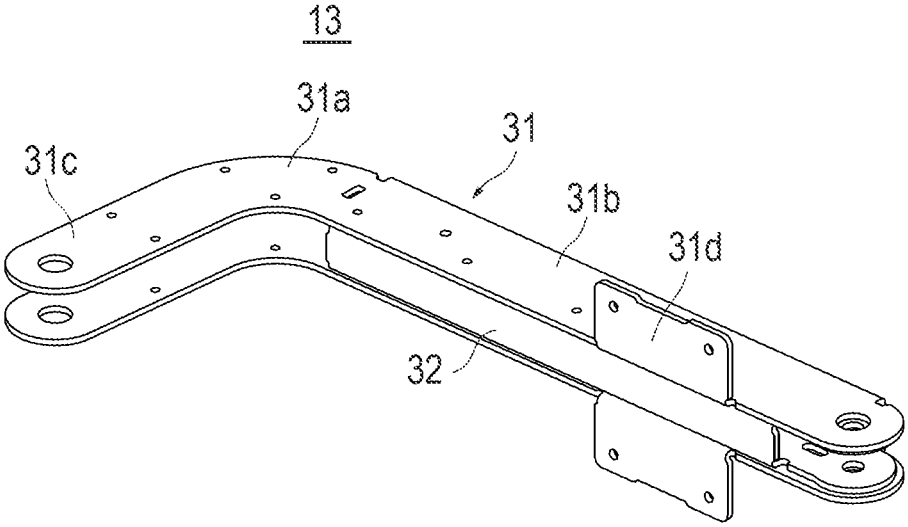
FIGS. 5A and 5B are perspective views of a main arm of the embodiment
Figure 5B:
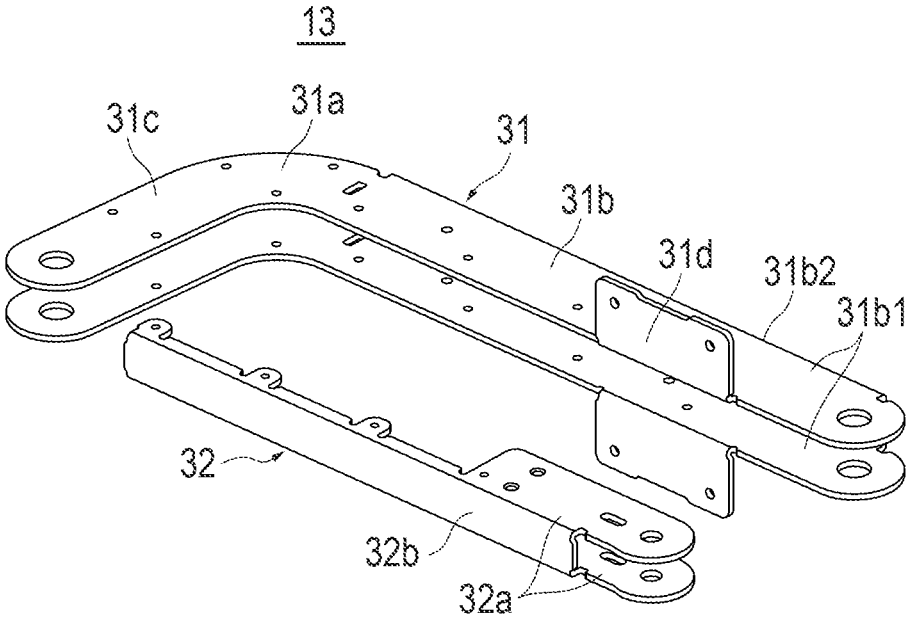

As illustrated in FIGS. 5A and 5B, the arm body 31 has an L-shape, and includes a straight short-side portion 31*c* and a straight long-side portion 31*b* on either side of a bent portion 31*a*. The long-side portion 31*b* of the arm body 31 has a squared U-shape in cross section, and includes a pair of opposing side plates 31*b*1, and a connecting plate 31*b*2 that connects the pair of side plates 31*b*1. A mounting portion 31*d* on which the connecting bar 3 is mounted is formed integrally with the pair of side plates 31*b*1 of the long-side portion 31*b*. The arm body 31 is produced by pressing a metal plate.

As illustrated in FIGS. 5A and 5B, the assist arm 32 has a squared U-shape in cross section, and includes a pair of opposing side plates 32*a*, and a connecting plate 32*b* that connects the pair of side plates 32*a*. The assist arm 32 is produced by pressing a metal plate. The assist arm 32 is inserted between the side plates 31*b*1 of the arm body 31 to form the main arm 13 into a square tubular shape in cross section.

As illustrated in FIG. 4, a substantially L-shaped resin spacer 36 is inserted between a pair of side plates of the short-side portion 31*c* of the arm body 31. The assist arm 32 and the spacer 36 are fixed to the arm body 31 with a screw. The assist arm 32 and the spacer 36 increase the strength of the main arm 13.

Figure 7A:
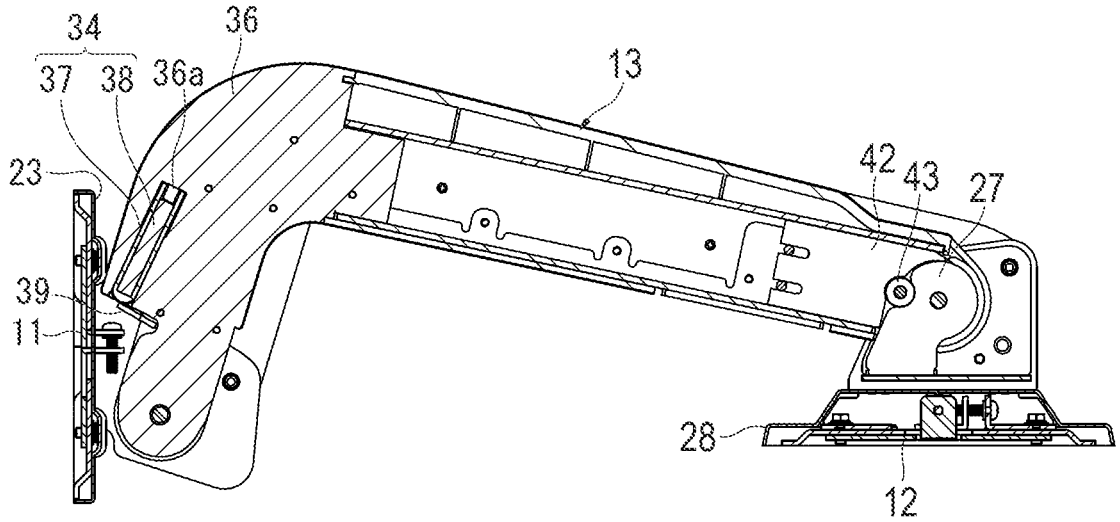
FIGS. 7A and 7B are cross-sectional views of the hinge of the embodiment

As illustrated in FIG. 7A, a hole 36*a* into which the damper mechanism 34 is inserted is formed in the spacer 36. The damper mechanism 34 includes a linear damper 38 and a damper holder 37. The damper holder 37 has a bottomed tubular shape. The linear damper 38 is housed in the damper holder 37. A damper stopper 39 is mounted on the main body-side member 11. When the door 4 has closed to the vicinity of the closed position, the damper holder 37 comes into contact with the damper stopper 39 to generate a damping force.

Figure 7B:
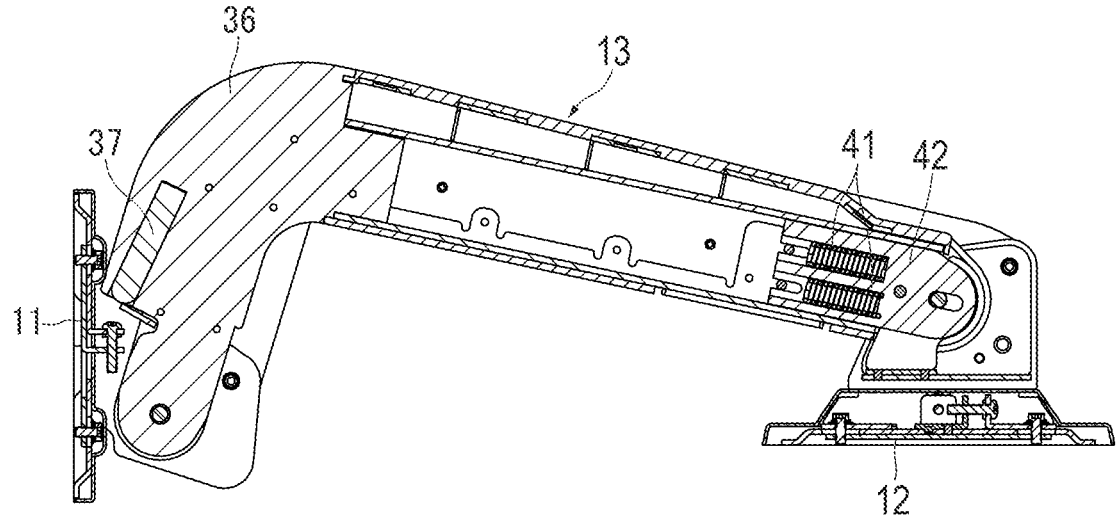

As illustrated in FIG. 4, the catch mechanism 33 is integrated into a tubular space between the arm body 31 and the assist arm 32. The catch mechanism 33 includes a compression spring 41, a spring case 42, and a roller 43. As illustrated in FIGS. 7A and 7B, the spring case 42 is provided to the main arm 13 in such a manner as to be movable in the length direction. The roller 43 is provided to the spring case 42 in such a manner as to be rotatable. The compression spring 41 biases the roller 43 toward the cam 27 of the door-side member 12. When the door 4 has closed to the vicinity of the closed position, the roller 43 fits into a recess of the cam 27 as illustrated in FIG. 7A, and the door 4 closes automatically. When the door 4 opens and the roller 43 comes into contact with an arc surface of the cam 27, an arbitrary angle of opening of the door 4 is maintained.

As illustrated in FIG. 4, the first link 14 has an L-shape, and includes a straight short-side portion 14*e* and a straight long-side portion 14*d* on either side of a bent portion 14*c*. The first link 14 has a plate shape. The second link 15 also has an L-shape, and includes a straight short-side portion 15*e* and a straight long-side portion 15*d* on either side of a bent portion 15*c*. The second link 15 also has a plate shape.

A finger pinch prevention cover 41 has an L-shape, and includes an upper cover 41*a*, and a lower cover 41*b*. Each of the upper cover 41*a* and the lower cover 41*b* includes a straight long-side portion and a straight short-side portion on either side of a bent portion as in the main arm 13. The upper cover 41*a* is mounted on the top of the main arm 13. The lower cover 41*b* is mounted on the bottom of the main arm 13. The upper cover 41*a* and the lower cover 41*b* surround the main arm 13. Holes 42*a* and 42*b* where the first shaft 13*a* and the second shaft 13*b* penetrate are formed in the upper cover 41*a* and the lower cover 41*b*. Reference signs 43*a* and 43*b* denote collars. The width (the width in a direction orthogonal to the length direction) of each of the upper cover 41*a* and the lower cover 41*b* is longer than that of the main arm 13.

As illustrated in FIGS. 8A to 8C, the finger pinch prevention cover 41 eliminates a gap between the main arm 13 and the first link 14 in axial view, and also eliminates a gap between the main arm 13 and the second link 15 in axial view. A gap does not appear between the finger pinch prevention cover 41 and the first link 14 in axial view, and a gap does not appear between the finger pinch prevention cover 41 and the second link 15 in axial view, all the way from the closed position to open position of the door 4.

Figure 6A:
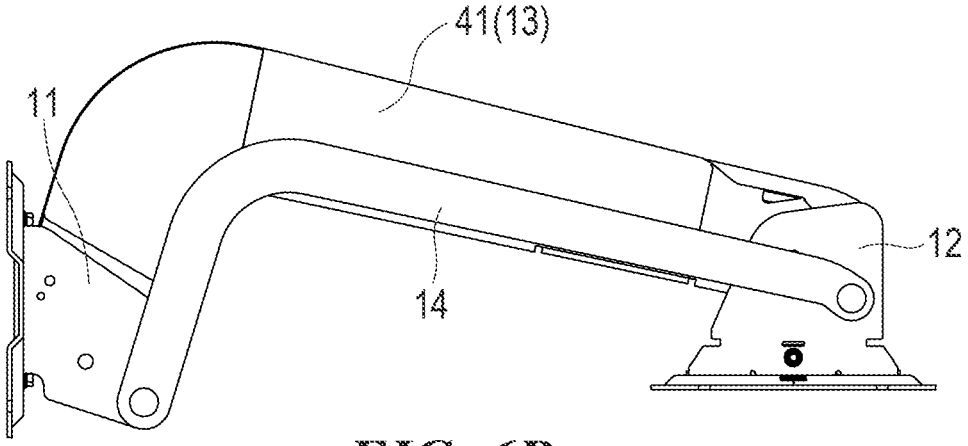
FIGS. 6A to 6D are detail views of the hinge of the embodiment
Figure 6B:
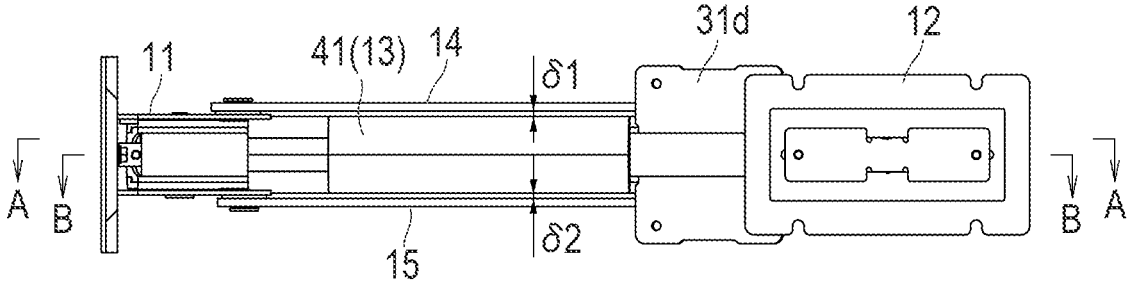
Figure 6C:
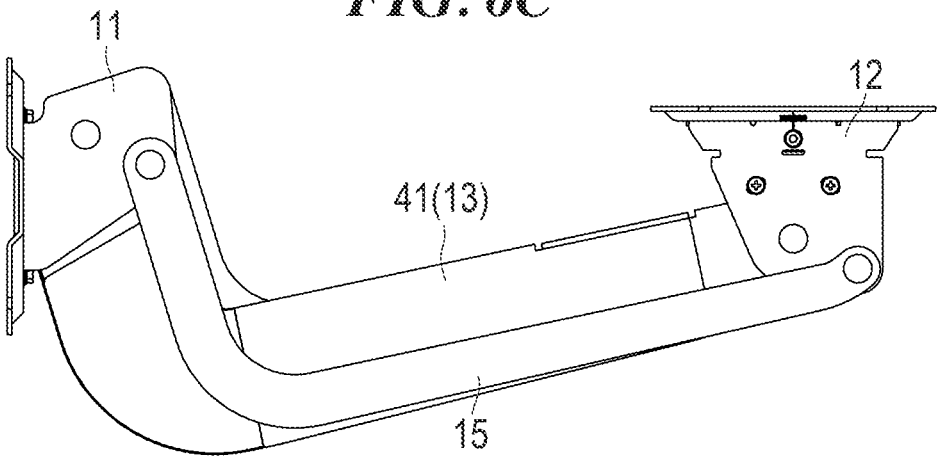
Figure 6D:
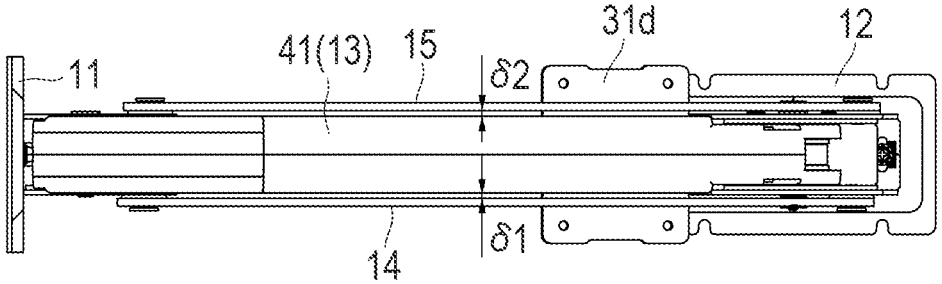

Moreover, as illustrated FIGS. 6B and 6D, the finger pinch prevention cover 41 reduces or eliminates a gap in the axial direction between the main arm 13 and the first link 14, and also reduces or eliminates a gap in the axial direction between the main arm 13 and the second link 15. A gap 61 in the axial direction between the finger pinch prevention cover 41 and the first link 14 and a gap 62 in the axial direction between the finger pinch prevention cover 41 and the second link 15 is, for example, from equal to or greater than 0 mm to equal to or less than 2 mm.

Figure 9:
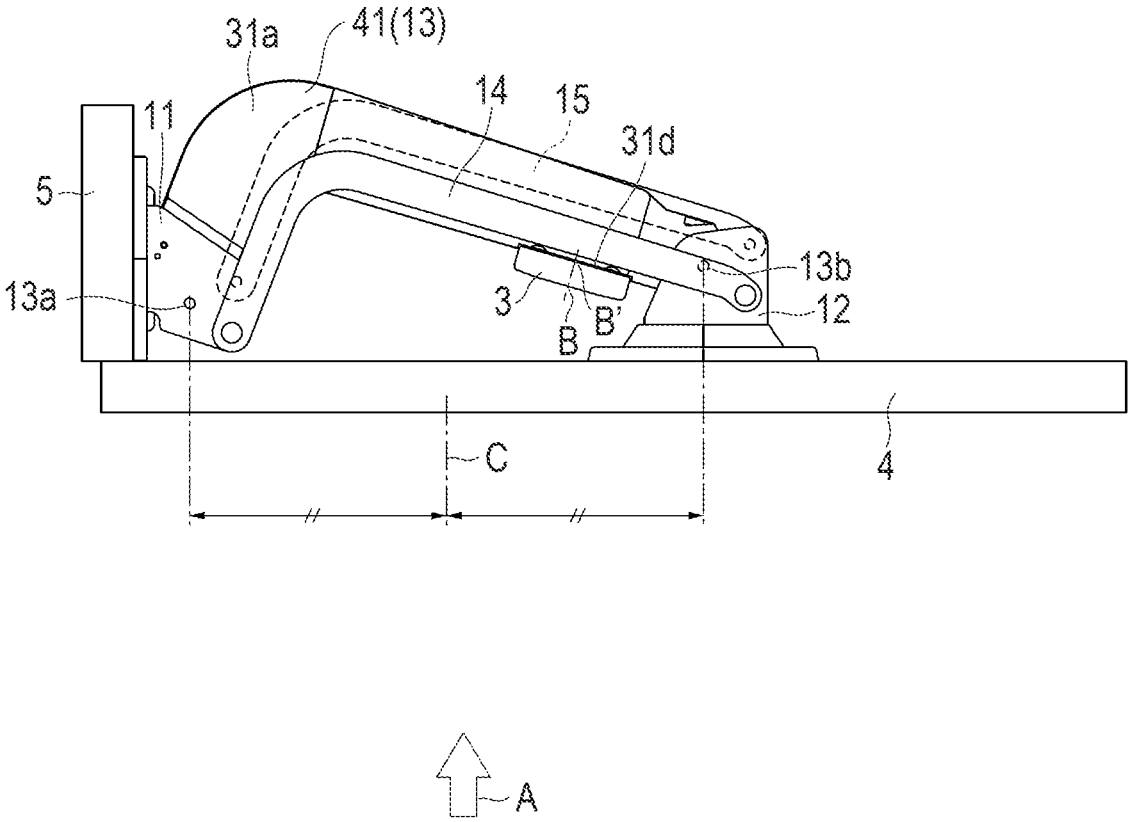
FIG. 9 is a plan view of the door opening/closing apparatus of the embodiment.

As illustrated in FIGS. 1A to 1C, the plate-shaped connecting bar 3 extending in the up-and-down direction is mounted on the pair of the upper and lower hinges 2*a* and 2*b* with fastening members such as screws. As illustrated in FIG. 9, the connecting bar 3 is mounted on the mounting portion 31*d* of the main arm 13. The mounting method of the connecting bar 3 is not particularly limited. For example, a screw is caused to penetrate through each of four corners of the mounting portion 31*d*. A square nut is threadedly engaged with the screw. The square nuts are aligned with and then inserted into grooves in the connecting bar 3. The screws are tightened and consequently the connecting bar 3 can be mounted on the mounting portion 31*d*.

The mounting portion 31*d* is placed on the door 4 side of the main arm 13. The connecting bar 3 is mounted on the door 4 side of the main arm 13. Moreover, a center B' of the mounting portion 31*d* in a width direction thereof and a center B of the connecting bar 3 in a width direction thereof are placed on the second shaft 13*b* side relative to a center C between the first shaft 13*a* of the main arm 13 and the second shaft 13*b* of the main arm 13 in front view (indicated by an open arrow A in FIG. 9) in a state where the door 4 is in the closed position. In the embodiment, the entire mounting portion 31*d* and the entire connecting bar 3 are placed on the second shaft 13*b* side relative to the center C. As illustrated in FIGS. 8A to 8C, the connecting bar 3 is located forward of the first link 14 and the second link 15 in the opening direction all the way from the closed position to open position of the door 4. The connecting bar 3 does not interfere with the first link 14 and the second link 15.

The configuration of the door opening/closing apparatus 1 of the embodiment has been described above. The door opening/closing apparatus 1 of the embodiment has the following effects:

The main arm 13 includes the bent portion 31*a*. Closer to the second shaft 13*b* on the main arm 13 indicates closer to the door 4. The connecting bar 3 is placed on the door 4 side and the second shaft 13*b* side of the main arm 13. Accordingly, the connecting bar 3 can be put closer to the back of the door 4. Hence, storage space in the main body 5 can be expanded.

Figure 10:
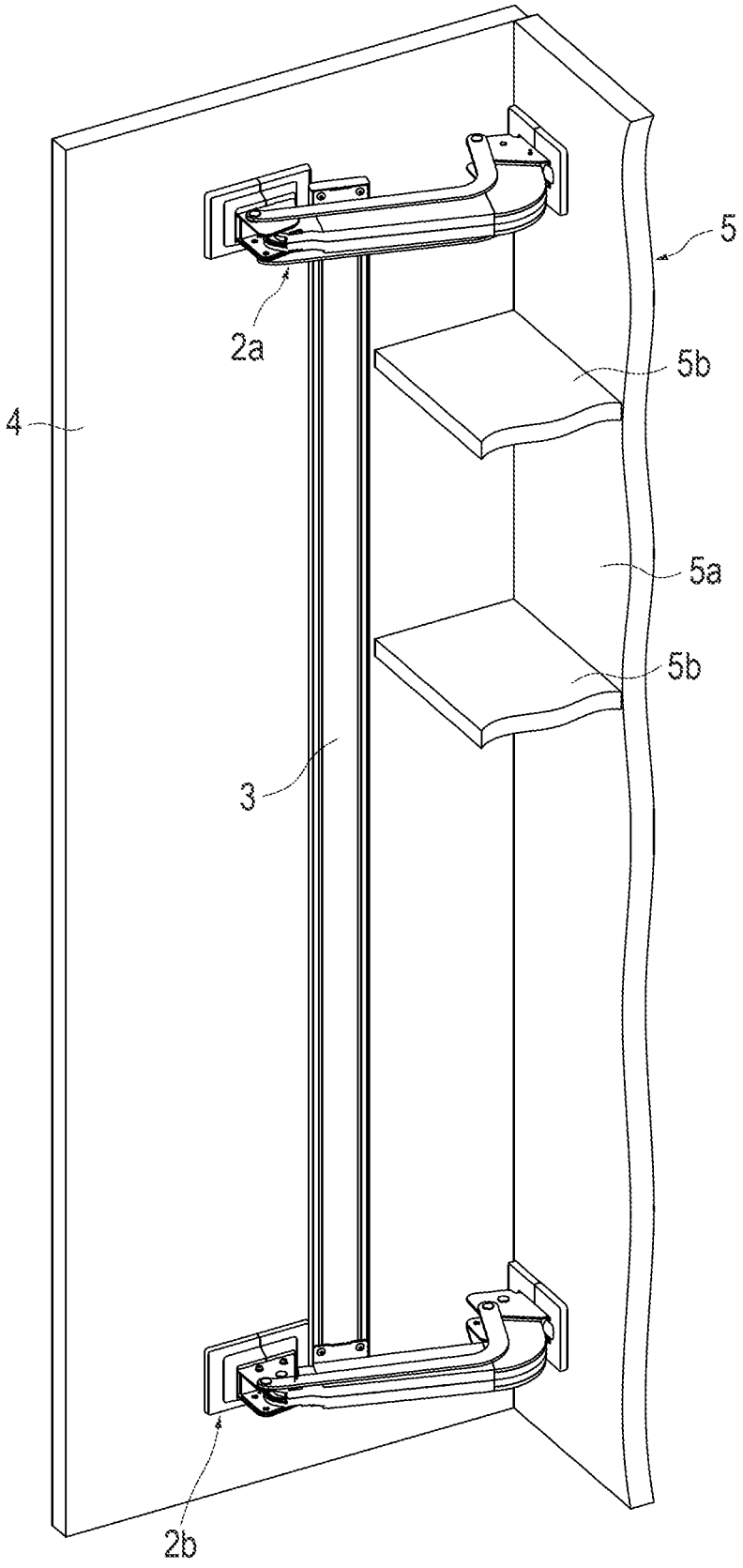
FIG. 10 is a perspective view of the back side of the cabinet on which a shelf has been mounted.
Figure 11:
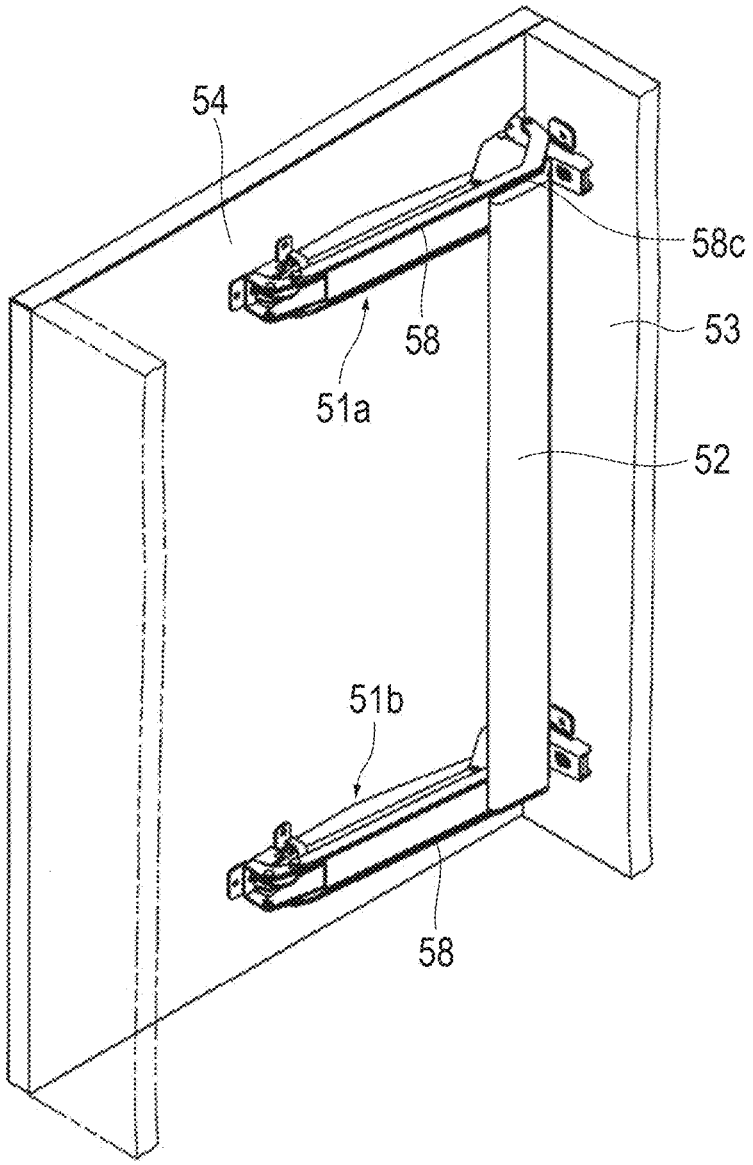
FIG. 11 (Prior Art)
FIG. 11 is a perspective view of a known door opening/closing apparatus.
Figure 12A:
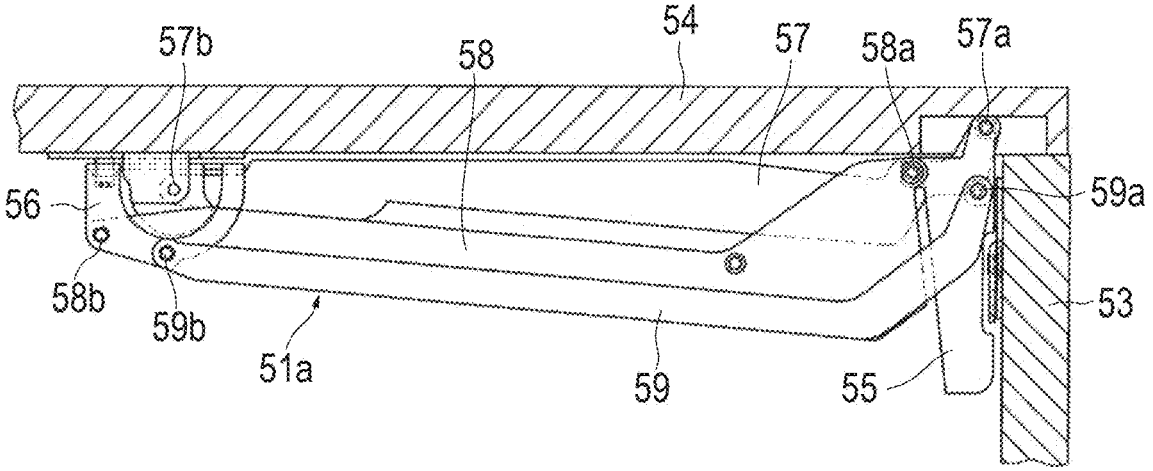
FIG. 12A (Prior Art)
FIGS. 12A and 12B are plan views of a hinge of the known door opening/closing apparatus
Figure 12B:
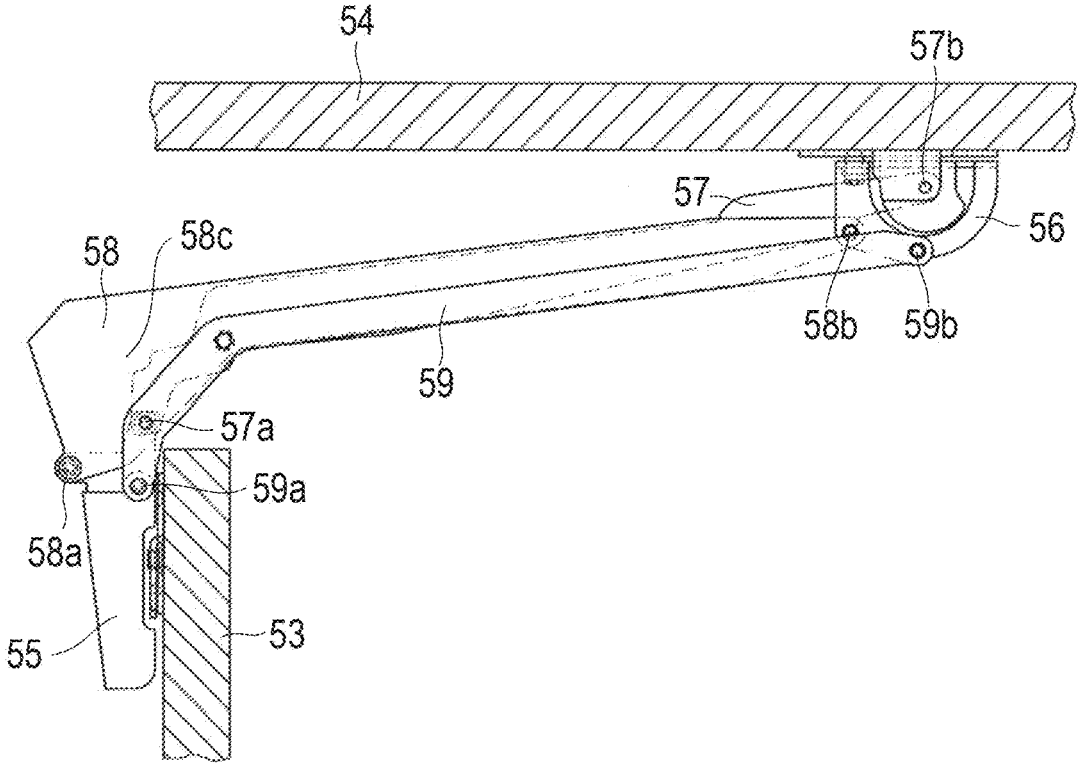
FIG. 12B (Prior Art)

Moreover, the connecting bar 3 is placed close to the second shaft 13*b*. Therefore, even if a shelf 5*b* is installed on the side plate 5*a* of the main body 5, for example, as illustrated in FIG. 10, it is possible to prevent the shelf 5*b* from interfering with the connecting bar 3.

The first link 14 is placed on one side of the main arm 13 in the axial direction. The second link 15 is placed on the other side of the main arm 13 in the axial direction. Accordingly, it is possible to ensure the strength of the door opening/closing apparatus 1 and to render the door opening/closing apparatus 1 compact.

The main arm 13 includes the metal arm body 31 of a squared U-shape in cross section, and the metal assist arm 32 of a squared U-shape in cross section fastened to the arm body 31. The main arm 13 is formed into a square tubular shape in cross section. Accordingly, it is possible to ensure the strength of the main arm 13.

The finger pinch prevention cover 41 that reduces or eliminates the gaps between the main arm 13 and the first link (the gap in axial view and the gap 61, 62 in the axial direction) is mounted on the main arm 13. Accordingly, it is possible to prevent fingers from getting caught in these gaps. The same applies to the gaps between the main arm 13 and the second link 15.

The present invention is not limited to the realization of the above embodiment, and can be realized in various embodiments within the scope where the gist of the present invention is not changed.

In the above embodiment, the door opening/closing apparatus is mounted on the side plate of the main body, and the door is opened and closed in the left-and-right direction. However, it is also possible to mount the door opening/closing apparatus on an upper or lower plate of the main body to open and close the door in the up-and-down direction.

In the above embodiment, the connecting bar is mounted on a pair of hinges. It is also possible to mount the connecting bar on three or more hinges.

In the above embodiment, there is no gap between the finger pinch prevention cover and the first link in axial view. However, there may be a gap that is too narrow to pinch fingers. The same applies to the gap between the finger pinch prevention cover and the second link in axial view.

The description is based on Japanese Patent Application No. 2018-198999 filed on Oct. 23, 2018, the entire contents of which are incorporated herein.

REFERENCE SIGNS LIST

1 Door opening/closing apparatus
2*a*, 2*b* Hinge
3 Connecting bar
4 Door
5 Main body
11 Main body-side member
12 Door-side member
13 Main arm
13*a* First shaft of the main arm
13*b* Second shaft of the main arm
14 First link
14*a* First shaft of the first link
14*b* Second shaft of the first link
15 Second link
15*a* First shaft of the second link
15*b* Second shaft of the second link
31 Arm body
31*a* Bent portion of the main arm
32 Assist arm
41 Finger pinch prevention cover
A Door in front view
B Center of the connecting bar in width direction
C Center between the first and second shafts of the main arm

The invention claimed is:

1. A door opening/closing apparatus comprising:

at least two hinges; and a connecting bar configured to be connected to the at least two hinges, wherein each hinge includes a main body-side member configured to be mounted on an inner surface of a main body; a door-side member configured to be mounted on the back of a door; a main arm configured to be pivotably connected to the main body-side member and the door-side member; a first link configured to be pivotably connected to the main body-side member and the door-side member; and a second link configured to be pivotably connected to the main body-side member and the door-side member, three first shafts about which the main arm, the first link, and the second link pivot relative to the main body-side member are placed on vertices of a triangle in axial view, three second shafts about which the main arm, the first link, and the second link pivot relative to the door-side member are placed on vertices of a triangle in the axial view, the main arm includes a bent portion, the door opening/closing apparatus causes the door to move parallel to itself between a closed position and an open position, the connecting bar is mounted on a door side of the main arm, and the center of the connecting bar in a width direction thereof is placed on the second shaft side relative to the center between the first shaft of the main arm and the second shaft of the main arm in a front view of the door in a state where the door is in the closed position.

2. The door opening/closing apparatus according to claim 1, wherein the first link is placed on one side of the main arm in the axial direction, displaced from the main arm, and the second link is placed on the other side of the main arm in the axial direction, displaced from the main arm.

3. The door opening/closing apparatus according to claim 2, wherein a finger pinch prevention cover configured to reduce or eliminate a gap between the main arm and the first link in the axial view, and a gap between the main arm and the second link in the axial view is mounted on the main arm.

4. The door opening/closing apparatus according to claim 3, wherein the finger pinch prevention cover is mounted on the main arm in such a manner as to reduce or eliminate a gap in the axial direction between the main arm and the first link and a gap in the axial direction between the main arm and the second link.

5. The door opening/closing apparatus according to claim 2, wherein a finger pinch prevention cover is mounted on the main arm in such a manner as to reduce or eliminate a gap in the axial direction between the main arm and the first link and a gap in the axial direction between the main arm and the second link.

6. The door opening/closing apparatus according to claim 2, wherein the main arm includes an arm body of a squared U-shape in cross section, and an assist arm of a squared U-shape in cross section fastened to the arm body, and is formed into a square tubular shape in cross section.

7. The door opening/closing apparatus according to claim 1, wherein the main arm includes an arm body of a squared U-shape in cross section, and an assist arm of a squared U-shape in cross section fastened to the arm body, and is formed into a square tubular shape in cross section.

8. A hinge comprising:

a main body-side member configured to be mounted on an inner surface of a main body; a door-side member configured to be mounted on the back of a door; a main arm configured to be pivotably connected to the main body-side member and the door-side member; a first link configured to be pivotably connected to the main body-side member and the door-side member; and a second link configured to be pivotably connected to the main body-side member and the door-side member, wherein three first shafts about which the main arm, the first link, and the second link pivot relative to the main body-side member are placed on vertices of a triangle in axial view, three second shafts about which the main arm, the first link, and the second link pivot relative to the door-side member are placed on vertices of a triangle in the axial view, the main arm includes a bent portion, the hinge causes the door to move parallel to itself between a closed position and an open position, a mounting portion of the main arm on which a connecting bar is mounted is placed on a door side of the main arm, and the center of the mounting portion in a width direction thereof is placed on the second shaft side relative to the center between the first shaft of the main arm and the second shaft of the main arm in a front view of the door in a state where the door is in the closed position.

* * * * *